US005316253A

United States Patent [19]

Flathau et al.

[11] Patent Number: 5,316,253

[45] Date of Patent: May 31, 1994

[54] SCAFFOLD BRACKET

[75] Inventors: Robert J. Flathau, Cary; Frank T. Connors, Deerfield, both of Ill.

[73] Assignee: Symons Corporation, Des Plaines, Ill.

[21] Appl. No.: 984,855

[22] Filed: Dec. 3, 1992

[51] Int. Cl.[5] ..... A47G 29/02

[52] U.S. Cl. ..... 248/235

[58] Field of Search ..... 248/235, 239, 240, 240.3, 248/241, 242, 351; 182/62, 82, 106; 52/36.4

[56] References Cited

U.S. PATENT DOCUMENTS

| | | | |
|---|---|---|---|
| 1,449,700 | 3/1923 | Sampson | 248/235 |
| 2,855,654 | 10/1958 | Stroben | 248/235 X |
| 2,882,101 | 4/1959 | Michalak et al. | 248/235 |
| 3,119,590 | 1/1964 | Eriksson | 248/242 X |
| 3,776,498 | 12/1973 | Peters et al. | 182/82 X |
| 4,450,121 | 5/1984 | Bequette | 248/240.3 X |

*Primary Examiner*—Ramon O. Ramirez
*Attorney, Agent, or Firm*—Wood, Phillips, VanSanten, Hoffman & Ertel

[57] ABSTRACT

In order to make it possible to align a concrete form while at the same time providing a safe working walkway therealong, a scaffold bracket comprises a generally triangular shaped brace having an attachment leg, a plank supporting leg and a brace leg. The attachment leg is adapted to be secured to an outer surface of the concrete form, the plank supporting leg extends generally transversely of the attachment leg, and the brace leg extends from the attachment leg to the plank supporting leg at an acute angle to both the attachment leg and the plank supporting leg. A first stop is provided on the plank supporting leg at a preselected distance outwardly of the attachment leg to define a waler bracket for accepting a plank of predetermined width for aligning the concrete form. A second stop is provided on the plank supporting leg at a preselected distance outwardly of the first stop to define an outer limit for accepting one or more planks of predetermined width for creating a working walkway. The brace is configured in such manner that the attachment leg can cooperate with one or more spaced fasteners on the outer surface of the concrete form such that the attachment leg is secured to the spaced fasteners with the planks of predetermined width suitably positioned on the plank supporting leg. In a preferred embodiment of the scaffold bracket of the present invention, the second stop takes the form of a guardrail pocket having an opening adapted to accept an upright for forming a guardrail with other such uprights at the outer limit of the working walkway.

20 Claims, 2 Drawing Sheets

SCAFFOLD BRACKET

FIELD OF THE INVENTION

The present invention is generally directed to the field of accessories for concrete forms and the like and, more particularly, a scaffold bracket which serves to define a waler bracket and also serves to support a working walkway.

BACKGROUND OF THE INVENTION

In recent years, it is recognized that there have been significant advancements in the field of concrete forming. It is known, for instance, that there are a wide variety of forming systems which are now available for nearly every conceivable concrete forming application. In addition, there have been a number of different types of accessories developed for use with the various concrete forming systems.

As will be appreciated, a variety of forming systems have been specifically developed for particular applications. Among these are forms for bridge piers, beams and large walls, forms for round tanks and curved walls, forms for heavy construction, box culvert travelers, room tunnel forms, bridge deck systems, forms for curbs and gutters, and even specialized designs for unique concrete forming requirements. In addition to these unique types of systems, it is well known that concrete forming is entirely common for pouring walls.

In wall forming systems, it is typical for the panels to be designed for vertical positioning. The panels and fillers are conventionally available in a variety of heights and backing bar configurations for specific applications. When workmen utilize such forming systems, there are oftentimes two seemingly unrelated requirements.

First, a forming system is typically required to have precise alignment. This has conventionally been accomplished by the utilization of waling and, in hand setting applications, waling is usually necessary for alignment only. In other words, the waling usually need not form a structural part of the form work.

In addition to the requirement for waling, a forming system is required to utilize scaffold brackets in many applications. The scaffold bracket must typically provide a safe working platform and, naturally, it should also be capable of quick attachment to form work. In addition, the scaffold bracket should be capable of fitting on a variety of forms in order to provide maximum versatility.

In other words, since forming systems are provided in a variety of different sizes, a scaffold bracket should be sufficiently versatile to quickly attach to any such system.

The present invention is directed to overcoming one or more of the foregoing problems and achieving one or more of the resulting objects.

SUMMARY OF THE INVENTION

It is a principal object of the present invention to provide a scaffold bracket for utilization on a concrete form. It is a further object of the present invention to provide a multifunction scaffold bracket that serves to define a waler bracket and also serves to support a safe working walkway thereon. It is another object of the present invention to provide a versatile scaffold bracket to fit different forms.

Accordingly, the present invention is directed to a scaffold bracket for a concrete form which comprises a generally triangular shaped brace. The brace includes an attachment leg adapted to be secured to an outer surface of the concrete form, a plank supporting leg extending generally transversely of the attachment leg, and a brace leg extending from the attachment leg to the plank supporting leg at an acute angle to both of the attachment and plank supporting legs. A first stop is provided on the plank supporting leg at a preselected distance outwardly of the attachment leg to define a waler bracket for accepting a plank of a predetermined width for aligning the concrete form. A second stop is provided on the plank supporting leg at a preselected distance outwardly of the first stop to define an outer limit for accepting one or more planks of predetermined width for creating a working walkway. The scaffold bracket also includes means associated with the attachment leg for cooperating with one or more spaced fasteners on the outer surface of the concrete form such that the attachment leg is secured to the spaced fasteners with the planks of predetermined width suitably positioned on the plank supporting leg. In a highly preferred embodiment, the second stop takes the form of a guardrail pocket having an opening adapted to accept an upright for forming a guardrail.

In the preferred embodiment, the outer surface of the concrete form is adapted to be disposed in a generally vertical orientation when the form is set up for a concrete pouring operation. The generally triangular shaped brace is then advantageously adapted to be secured to the generally vertical outer surface of the concrete form with the attachment leg in a generally vertical orientation and with the plank supporting leg in a generally horizontal orientation. With this arrangement, the planks of predetermined width will be positioned on the plank supporting leg of the generally triangular shaped brace in a generally horizontal orientation.

In the exemplary embodiment, the first stop on the plank supporting leg is preferably located at a first fixed distance outwardly of the attachment leg and the second stop on the plank supporting leg is preferably located at a second fixed distance outwardly of the first stop. Advantageously, the first fixed distance comprises the width of a single 2× plank and the second fixed distance comprises the width of one or more 2× planks. When so configured, the waler bracket can thus be utilized with a single 2× plank and the working walkway can be utilized with one or more additional 2× planks which together form a safe working area between the concrete form and the guardrail.

As previously mentioned, the second stop on the plank supporting leg preferably comprises a guardrail pocket positioned at the outer limit for the working walkway such that the opening in the guardrail pocket is adapted to accept an upright for forming a guardrail with other such uprights. In addition, the scaffold bracket preferably includes means associated with the guardrail pocket for securing the upright within the guardrail pocket at a point immediately outwardly of the working walkway so as to be immediately adjacent an outermost one of the planks positioned on the working walkway.

In the exemplary embodiment, the spaced fasteners on the outer surface of the concrete form include at least a pair of shoulder bolts positioned in generally vertically spaced relation on a corresponding pair of spaced parallel cross bars of the concrete form. Still additionally, the means cooperating with the fasteners advantageously includes at least a pair of pear shaped slots in spaced relation on the attachment leg of the generally triangular shaped brace to register with and fit over the shoulder bolts.

As previously suggested, the plank in the waler bracket and the planks in the working walkway define a substantially continuous walkway surface between the outer surface of the concrete form and the guardrail. It is also advantageous to provide means associated with the plank supporting leg for securing each of the planks in the working walkway in such a manner as to prevent any significant movement of any of the planks relative to the plank supporting leg. Still additionally, the first and second stops on the plank supporting leg are preferably located such that the waler bracket portion accepts a single 2"×6" plank and the working walkway accepts three (3) 2"×6" planks therewithin.

Still additional details of the present invention relate to the means cooperating with the fasteners on the outer surface of the concrete form, i.e., the pear shaped slots previously discussed. In a most highly preferred embodiment, there is provided a single upper pear shaped slot adjacent the plank supporting leg and a plurality of lower pear shaped slots adjacent the brace leg wherein the spacing of the lower pear shaped slots is such as to permit placement of the scaffold bracket on a wide variety of different sizes of concrete forms. In other words, the spacing of the upper and lower pear shaped slots is such that the upper slot and one of the lower slots will register with and fit over two shoulder bolts on a variety of different concrete forms.

Other objects, advantages, details and features of the present invention will become apparent from a consideration of the following specification taken in conjunction with the accompanying drawings.

DETAILED DESCRIPTION OF THE PREFERRED EMBODIMENT

Figure 1:
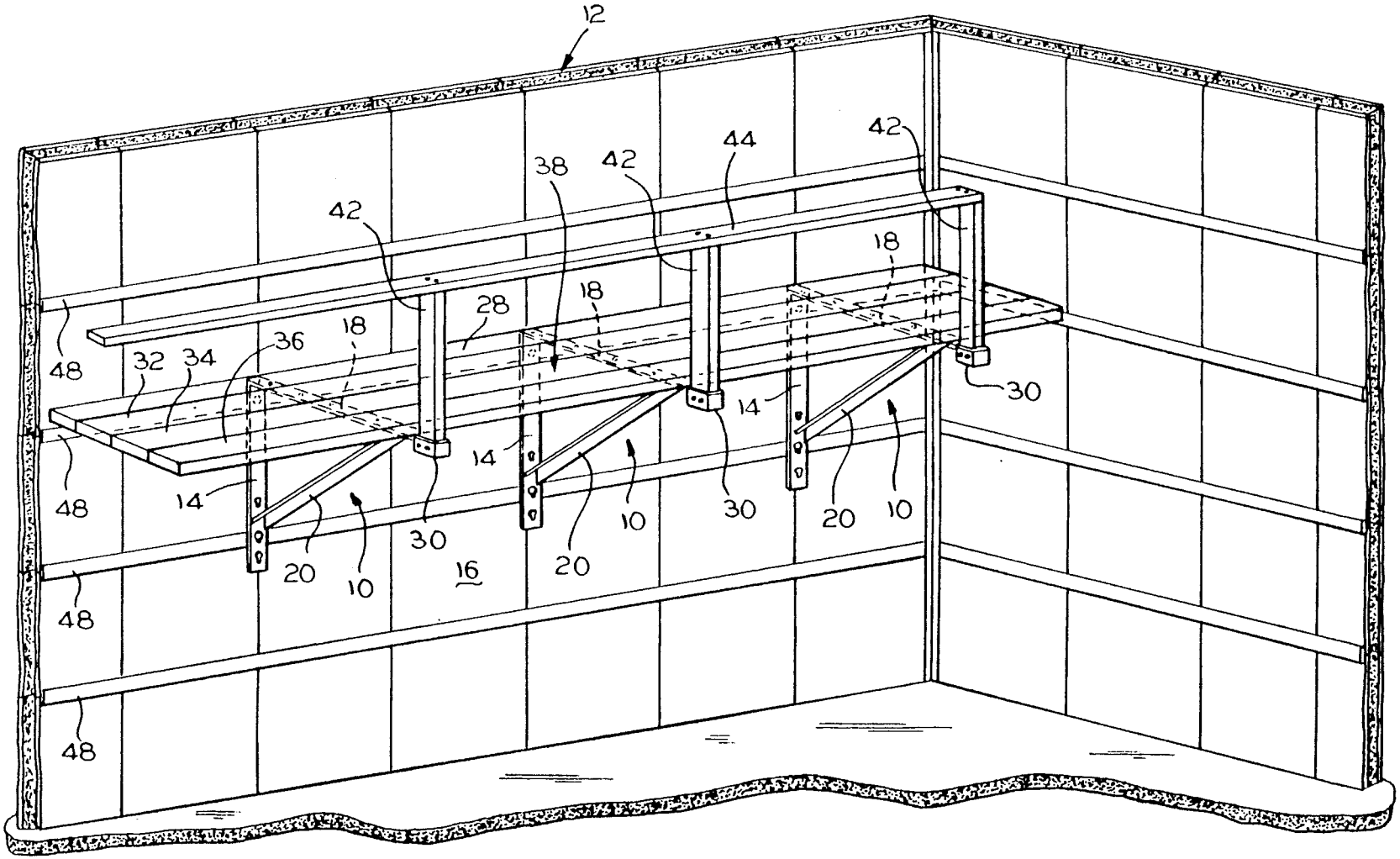
FIG. 1 is a perspective view of a concrete form utilizing scaffold brackets in accordance with the present invention.

In the illustrations given, and with reference first to FIG. 1, the reference numeral 10 designates generally a scaffold bracket for a concrete form 12 in accordance with the present invention. The scaffold bracket 10 will be seen to comprise a generally triangular shaped brace (see also FIG. 2) including an attachment leg 14 adapted to be secured to a vertically disposed outer surface 16 of the concrete form 12, a plank supporting leg 18 extending transversely of the attachment leg 14, and a brace leg 20 extending from the attachment leg 14 to the plank supporting leg 18 at an acute angle to both of the legs 14 and 18. In addition, and as best illustrated in FIG. 2, it will be seen that the scaffold bracket 10 includes a first stop 22 and a second stop 24 at spaced locations along the plank supporting leg 18.

In particular, the first stop 22 is provided on the plank supporting leg 18 at a first preselected fixed distance outwardly of the attachment leg 14 to define a waler bracket 26 for accepting a single 2× plank 28 of a predetermined width for aligning the concrete form 12. In addition, the second stop 24 is provided on the plank supporting leg 18 at a second preselected fixed distance outwardly of the first stop 22 in the form of a guardrail pocket 30 for accepting a plurality of 2× planks 32, 34, and 36 of a predetermined width for creating a working walkway generally designated 38. As will be seen from FIGS. 1 and 2, the guardrail pocket 30 is positioned at an outer limit for the working walkway 38 and includes an opening 40 adapted to accept an upright 42 for forming a guardrail 44 with other such uprights 42.

Figures 2, 3, 4:
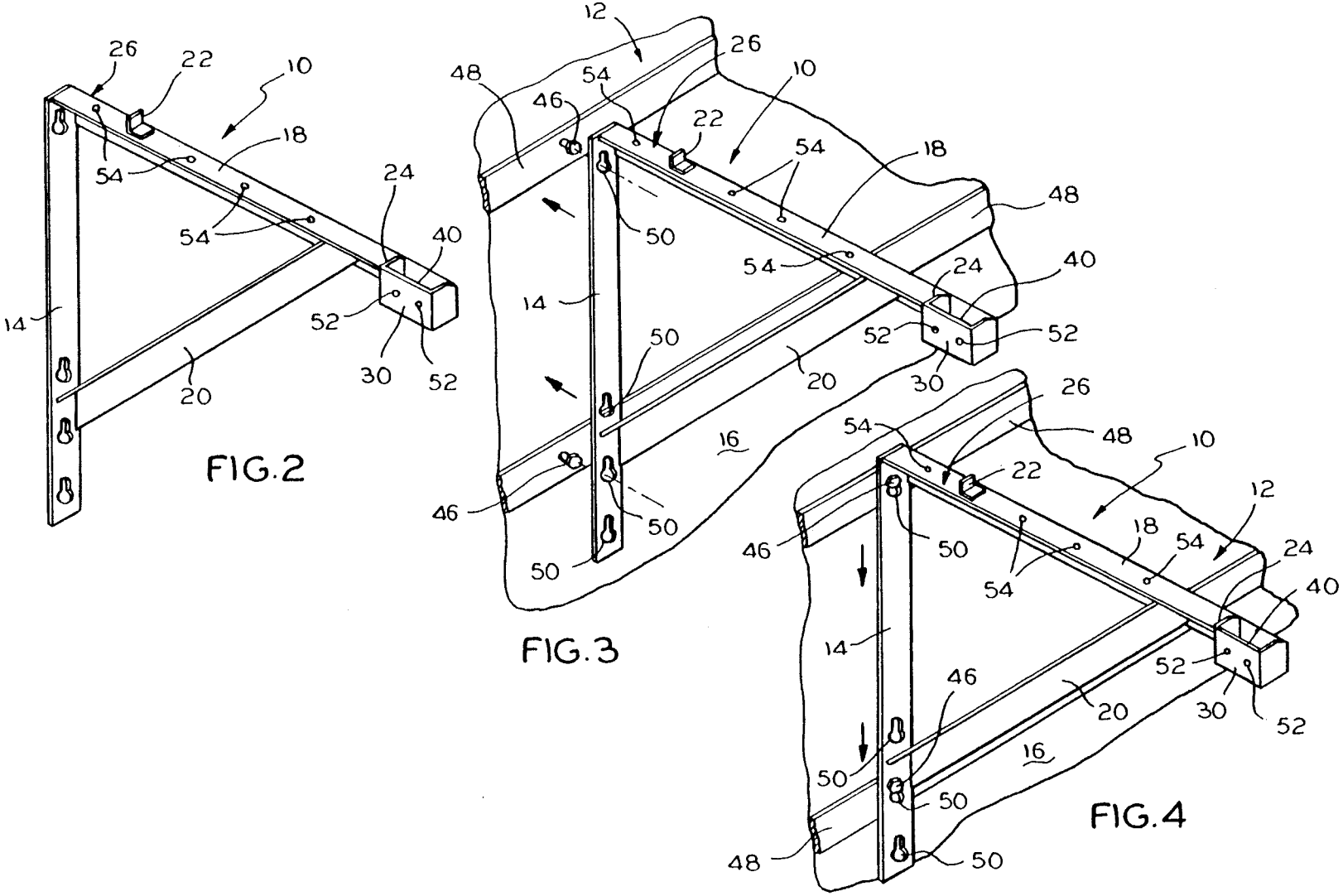
FIG. 2 is an enlarged perspective view of one of the scaffold brackets illustrated in FIG. 1.
FIG. 3 is a perspective view illustrating installation of scaffold bracket on a concrete form.
FIG. 4 is an enlarged perspective view illustrating the scaffold bracket fully installed on a concrete form crossbar.

Referring to FIGS. 3 and 4, the scaffold bracket 10 has means associated with the attachment leg 14 for cooperating with one or more spaced fasteners 46 on the outer surface 16 of the concrete form 12. This makes it possible to utilize the waler bracket 26 and the working walkway 38 with the attachment leg 14 secured to the spaced fasteners 46 on the outer surface 16 of the concrete form 12 such that the planks of predetermined width 28, 32, 34 and 36 are all positioned on the plank supporting leg 18 substantially as shown in FIG. 1. In the preferred embodiment, the spaced fasteners 46 on the outer surface 16 of the concrete form 12 include at least a pair of vertically spaced shoulder bolts positioned on cross bars 48 of the concrete form 12.

Referring specifically to FIGS. 3 and 4, the means cooperating with the fasteners 46 includes at least a pair of pear shaped slots 50 adapted to register with and fit over at least two of the shoulder bolts 46. Advantageously, there is provided a single upper pear shaped slot 50 adjacent the plank supporting leg 18 and a plurality of lower pear shaped slots 50 adjacent or near the intersection of the attachment leg 14 with the brace leg 20. With this arrangement, the scaffold bracket 10 is highly flexible since it will fit on a number of different sizes of forms where there is different spacing between adjacent ones of the cross bars such as 48.

Comparing FIGS. 1 and 2, it will be appreciated that the scaffold bracket 10 also includes means for securing an upright 42 in the guardrail pocket 30. The guardrail pocket 30 is preferably formed such that a 2× upright 42 will fit within the opening 40. As will be appreciated, the upright securing means includes a pair of holes 52 in the guardrail pocket 30 for securing an upright 42 with nails or the like.

Still referring to FIGS. 1 and 2, the scaffold bracket 10 may include means associated with the plank supporting leg 18 for securing each of the planks 28, 32, 34 and 36 so as prevent movement of any of the planks 28, 32, 34 and 36 relative to the plank supporting leg 18. This again may comprise at least one hole 54 for securing each of the planks 28, 32, 34 and 36 relative to the plank supporting leg 18 with a nail or the like. Also, and as will be appreciated from FIG. 1, the plank 28 in the waler bracket 24 serves with the planks 32, 34 and 36 in the working walkway 38 to define a substantially continuous walkway surface 56 between the outer surface 16 of the concrete form 12 and the guardrail 44.

From the foregoing, it will be appreciated that the present invention provides a highly versatile and multifunctional new scaffold bracket. This scaffold bracket is adapted to fit on different sizes of concrete forms while at the same time combining the functions of a waler bracket into a working walkway having a sturdy guardrail at the outer limit thereof. As a result, it will be appreciated that the present invention represents a truly significant advancement in the field of concrete forming accessories.

While in the foregoing there has been presented a preferred embodiment of the invention, it will be appreciated that the details herein given may be varied by those skilled in the art without departing from the true spirit and scope of the appended claims.

We claim:

1. A scaffold bracket for a concrete form, comprising:

a generally triangular shaped brace including an attachment leg adapted to be secured to an outer surface of said concrete form, a plank supporting leg extending generally transversely of said attachment leg, and a brace leg extending from said attachment leg to said plank supporting leg at an acute angle to both said attachment leg and said plank supporting leg;

a first stop on said plank supporting leg at a preselected distance outwardly of said attachment leg to define a waler bracket for accepting a plank of a predetermined width for aligning said concrete form;

a second stop on said plank supporting leg at a preselected distance outwardly of said first stop to define an outer limit for accepting one or more planks of predetermined width for creating a working walkway; and means associated with said attachment leg for cooperating with one or more spaced fasteners on said outer surface of said concrete form for utilizing said waler bracket and said working walkway with said attachment leg secured to said spaced fastener(s) on said outer surface of said concrete form such that said planks of predetermined width are positioned on said plank supporting leg.

2. The scaffold bracket of claim 1 wherein said outer surface of said concrete form is adapted to be disposed in a generally vertical orientation, said generally triangular shaped brace being adapted to be secured to said outer surface of said concrete form with said attachment leg in a generally vertical orientation and with said plank supporting leg in a generally horizontal orientation, said planks of predetermined width being positioned on said plank supporting leg of said generally triangular shaped brace in a generally horizontal orientation.

3. The scaffold bracket of claim 1 wherein said first stop on said plank supporting leg is at a first fixed distance outwardly of said attachment leg and said second stop on said plank supporting leg is at a second fixed distance outwardly of said first stop, said first fixed distance comprising the width of a single 2× plank and said second fixed distance comprising the width of one or more 2× planks such that said waler bracket can be utilized with said single plank and said working walkway can be utilized with said one or more planks in position thereon.

4. The scaffold bracket of claim 1 wherein said second stop on said plank supporting leg comprises a guardrail pocket at said outer limit for said working walkway with said guardrail pocket having an opening adapted to accept an upright for forming a guardrail with other such uprights, and including means associated with said guardrail pocket for securing said upright within said guardrail pocket at a point immediately outwardly of said working walkway so as to be immediately adjacent an outermost one of said one or more planks positioned on said working walkway.

5. The scaffold bracket of claim 1 wherein said spaced fasteners on said outer surface of said concrete form include at least a pair of shoulder bolts positioned in generally vertically spaced relation on a corresponding pair of spaced parallel cross bars of said concrete form, and said means cooperating with said fasteners including at least a pair of pear shaped slots in spaced relation on said attachment leg of said generally triangular shaped brace to register with and fit over said shoulder bolts on said cross bars of said concrete form.

6. A scaffold bracket for a concrete form, comprising:

a generally triangular shaped brace including an attachment leg adapted to be secured to a vertically disposed outer surface of said concrete form, a plank supporting leg extending transversely of said attachment leg, and a brace leg extending from said attachment leg to said plank supporting leg at an acute angle to said attachment leg and said plank supporting leg;

a first stop on said plank supporting leg at a first preselected fixed distance outwardly of said attachment leg to define a waler bracket for accepting a single 2× plank of a predetermined width for aligning said concrete form;

a second stop on said plank supporting leg at a second preselected fixed distance outwardly of said first stop in the form of a guardrail pocket for accepting a plurality of 2× planks of a predetermined width for creating a working walkway; and means associated with said attachment leg for cooperating with one or more spaced fasteners on said outer surface of said concrete form for utilizing said waler bracket and said working walkway with said attachment leg secured to said spaced fastener(s) on said outer surface of said concrete form such that said planks of predetermined width are positioned on said plank supporting leg.

7. The scaffold bracket of claim 6 wherein said generally triangular shaped brace is adapted to be secured to said outer surface of said concrete form with said attachment leg in a vertical orientation.

8. The scaffold bracket of claim 6 wherein said generally triangular shaped brace is adapted to be secured to said outer surface of said concrete form with said plank supporting leg in a horizontal orientation.

9. The scaffold bracket of claim 6 wherein said planks of predetermined width are positioned on said waler bracket and said working walkway of said generally triangular shaped brace in a horizontal orientation.

10. The scaffold bracket of claim 6 wherein said first and second stops are positioned such that said waler bracket accepts a single 2×6 inch plank and said working walkway accepts three 2×6 inch planks therewithin.

11. The scaffold bracket of claim 6 wherein said guardrail pocket is positioned at an outer limit for said working walkway and includes an opening adapted to accept an upright for forming a guardrail with other such uprights.

12. The scaffold bracket of claim 11 including means associated with said guardrail pocket for securing said upright at a point immediately outwardly of said working walkway immediately adjacent the outermost one of said planks on said working walkway.

13. The scaffold bracket of claim 11 wherein guardrail pocket is adapted to accept a 2× upright therewithin and said upright securing means includes a pair of holes for securing said upright within said guardrail pocket with nails.

14. The scaffold bracket of claim 6 wherein said spaced fasteners on said outer surface of said concrete form include at least a pair of vertically spaced shoulder bolts positioned on cross bars of said concrete form.

15. The scaffold bracket of claim 14 wherein said means cooperating with said fasteners includes at least a pair of pear shaped slots adapted to register with and fit over at least two of said shoulder bolts.

16. A scaffold bracket for a concrete form, comprising:

a generally triangular shaped brace including an attachment leg adapted to be secured to a vertically disposed outer surface of said concrete form, a plank supporting leg extending transversely of said attachment leg, and a brace leg extending from said attachment leg to said plank supporting leg at an acute angle to both said attachment leg and said plank supporting leg;

a first stop on said plank supporting leg at a first preselected fixed distance outwardly of said attachment leg to define a waler bracket for accepting a single 2× plank of a predetermined width for aligning said concrete form;

a second stop on said plank supporting leg at a second preselected fixed distance outwardly of said first stop in the form of a guardrail pocket for accepting a plurality of 2× planks of a predetermined width for creating a working walkway;

said guardrail pocket being positioned at an outer limit for said working walkway and including an opening adapted to accept an upright for forming a guardrail with other such uprights and including means for securing said upright in said guardrail pocket; and means associated with said attachment leg for cooperating with one or more spaced fasteners on said outer surface of said concrete form for utilizing said waler bracket and said working walkway with said attachment leg secured to said spaced fastener(s) on said outer surface of said concrete form such that said planks of predetermined width are positioned on said plank supporting leg;

said spaced fasteners on said outer surface of said concrete form including at least a pair of vertically spaced shoulder bolts positioned on cross bars of said concrete form, and said means cooperating with said fasteners including at least a pair of pear shaped slots adapted to register with and fit over at least two of said shoulder bolts.

17. The scaffold bracket of claim 16 wherein said plank in said waler bracket and said planks in said working walkway define a substantially continuous walkway surface between said outer surface of said concrete form and said guardrail.

18. The scaffold bracket of claim 16 wherein said means cooperating with said fasteners includes a single upper pear shaped slot adjacent said plank supporting leg and a plurality of lower pear shaped slots adjacent said brace leg.

19. The scaffold bracket of claim 16 including means associated with said plank supporting leg for securing each of said planks in said working walkway so as to prevent movement of any of said planks relative to said plank supporting leg.

20. The scaffold bracket of claim 19 wherein said guardrail pocket is adapted to accept a 2× upright therewithin and said upright securing means includes a pair of holes for securing said upright within said guardrail pocket with nails.

* * * * *